US008746938B2

(12) United States Patent
Lee et al.

(10) Patent No.: US 8,746,938 B2
(45) Date of Patent: Jun. 10, 2014

(54) LIGHT COMBINED WITH A CABLE

(75) Inventors: Jae Yong Lee, Jecheon-si (KR); Song Yi Kwon, Jecheon-si (KR)

(73) Assignee: Star Lighting Co., Ltd., Busan (KR)

( * ) Notice: Subject to any disclaimer, the term of this patent is extended or adjusted under 35 U.S.C. 154(b) by 217 days.

(21) Appl. No.: 13/510,104

(22) PCT Filed: Oct. 6, 2010

(86) PCT No.: PCT/KR2010/006816

§ 371 (c)(1),
(2), (4) Date: May 16, 2012

(87) PCT Pub. No.: WO2011/062366

PCT Pub. Date: May 26, 2011

(65) Prior Publication Data

US 2012/0243225 A1 Sep. 27, 2012

(30) Foreign Application Priority Data

Nov. 17, 2009 (KR) ..... 10-2009-0110937

(51) Int. Cl.
*F21V 21/008* (2006.01)
*F21V 21/00* (2006.01)
*F21V 5/04* (2006.01)

(52) U.S. Cl.
CPC ..... *F21V 21/00* (2013.01); *F21V 21/008* (2013.01); *F21V 5/04* (2013.01)
USPC ..... 362/391

(58) Field of Classification Search
CPC ..... F21V 5/04; F21V 21/00; F21V 19/003; F21V 19/0005; F21V 21/088; F21V 21/002; F21V 21/005; F21V 21/008; F21S 2/00; F21S 4/005; F21Y 2103/02; F21Y 2103/022; F21Y 2103/025
See application file for complete search history.

(56) References Cited

U.S. PATENT DOCUMENTS 4,342,073 A * 7/1982 Ranten ..... 362/294
8,517,566 B2 * 8/2013 Gordin ..... 362/249.02

FOREIGN PATENT DOCUMENTS

| | | |
|---|---|---|
| JP | 13059545 | 3/2001 |
| KR | 20-0392250 | 8/2005 |
| KR | 1020080076095 | 8/2008 |
| KR | 100901165 | 5/2009 |

* cited by examiner

*Primary Examiner* — Bao Q Truong
(74) *Attorney, Agent, or Firm* — IPLA P.A.; James E. Bame

(57) ABSTRACT

A light combined with a cable illuminates a cable-stayed bridge in which a deck slab is fixed by a cable, or a structure in which wires or cables are combined, so as to achieve improved visual landscaping effects. The light of the present invention comprises a frame (110), a lamp (120), a housing (130), and a switch (150). The frame (110) comprises: a through-hole (111) for the a cable (13) to pass therethrough; a plurality of lamp mounting grooves (112) formed along the circumference of the through-hole (111); and fastening holes (114) which are formed along the circumferential surface of the frame and communicate with the through-hole (111) in the horizontal direction, and each of which has an inner surface provided with a female screw thread. The lamp mounting grooves (112) are formed into steps such that lamp mounting grooves closer to the through-hole (111) are deeper than those farther away from the through-hole. The frame (110) further comprises a bar-shaped first fastening bolt (116) which passes through one of the fastening holes (114), and which has a circumferential surface with a male screw thread so as to engage with the female screw thread. The lamp (120) has light sources (121) fixed in the respective lamp mounting grooves (112) to emit light. The housing (130) accommodates the frame (110). The switch (150) controls the flickering operation of the lamp (120), and is installed within the housing (130).

9 Claims, 7 Drawing Sheets

LIGHT COMBINED WITH A CABLE

BACKGROUND OF THE INVENTION

The present invention relates to a light, and more particularly, to a light combined with a cable, which effectively illuminates a cable-stayed bridge in which a bridge deck is fixed by cables, or a structure in which wires or cables are combined, so as to achieve improved visual landscaping effects.

In general, larger structures (hereafter, referred to as a "subject"), such as a variety of sculptures for landscaping, products exhibited for sales presentation, bridges, or buildings, are illuminated to light up the appearance.

Creating the appearance using lights is performed by placing illumination of colors at locations depending on the shape of the subject or points thereof to be highlighted.

In addition, subjects include larger structures, such as a cable-stayed bridge.

As is known, the cable-stayed bridge 10 (see FIG. 1) is a bridge in which cables 13 obliquely extending from a tower 11 are connected to girders to fix a bridge deck 12 of the bridge, and thus is an advantageous structure in terms of economics and enhancing aesthetics. To allow the appearance of the cable-stayed bridge 10 to be visible even at a night, lights 100 are installed to illuminate each of cables 13. Specifically, as shown in FIG. 1 (i.e., a view schematically showing a state of installation of the lights which illuminate the cable-stayed bridge), a light 100 is separately disposed at a point where the cable 13 is connected to the bridge deck 12 and then illuminates upward along the cable 13, such that light beam of the light 100 can be irradiated in a longitudinal direction of the cable 13.

Thus, because each of cables 13 of the cable-stayed bridge 10 is illuminated by the light 100, locations and appearance of the cables 13 can be seen even at a night, so that the inherent structural/external characteristics of the cable-stayed bridge 10 can be enjoyed.

However, the light 100 according to the related art is disposed laterally to an existing cable 13, which is already installed, and illuminates in the longitudinal direction 13. Thus, the light 100 cannot shine a light beam parallel to the cable 13. Specifically, the arrangement aspect of the light 100 according to the related art is just a configuration for illuminating only lateral surfaces of the cables 13 which are obliquely arranged. Furthermore, the concentration of light 100 on the cable 13 is reduced due to diffusion of light beam, and also is reduced in distinguishability on the cable 13 due to being interfered with by light beams irradiated from other adjacent lights. Therefore, there is the problem of a plurality of lights 100 installed along the bridge deck 12 of the cable-stayed bridge 10 being configured to shine their light beams only towards the sky.

SUMMARY OF THE INVENTION

Accordingly, the present invention has been made keeping in mind the above problems occurring in the related art, and an object of the present invention is to provide a light combined with a cable, which can effectively illuminate a subject, such as a cable-stayed bridge, to emphasize shape characteristics of the subject, and can be installed on an existing subject, which is already installed, without additional manipulation of the subject.

In order to achieve the above objects, there is provided a light combined with a cable, including:

a frame including: a through-hole configured to allow the cable to be extended therethrough; a plurality of lamp mounting grooves disposed along a circumference of the through-hole, the plurality of lamp mounting grooves being formed in a stepped shape such that lamp mounting grooves closer to the through-hole are recessed deeper than those away from the through-hole; fastening holes formed along the circumferential surface of the frame to be horizontally extended through the through-hole, the fastening holes each having an inner surface provided with a female screw thread; and, bar-shaped first fastening bolts each extending through one of the fastening holes, the first fastening bolts each having a circumferential surface provided with a male screw thread so as to engage with the female screw thread;

a plurality of lamps fixed in the respective lamp mounting grooves, each having light sources for emitting a light beam;

a housing for accommodating and surrounding the frame; and a switch installed within the housing 130 for controlling on/off of the lamps.

According to the present invention, the light can be integrally fixed on a subject, such as the cables of a cable-stayed bridge, to illuminate in a longitudinal direction of the subject and parallel to the subject. As a result, there are obtained effects that the irradiated light beam can be integrated with the cables and also the light can be applied to an existing subject to be integrated with the subject.

DETAILED DESCRIPTION OF THE INVENTION

Reference will now be made in greater detail to the present invention with reference to the accompanying drawings.

Figure 2:
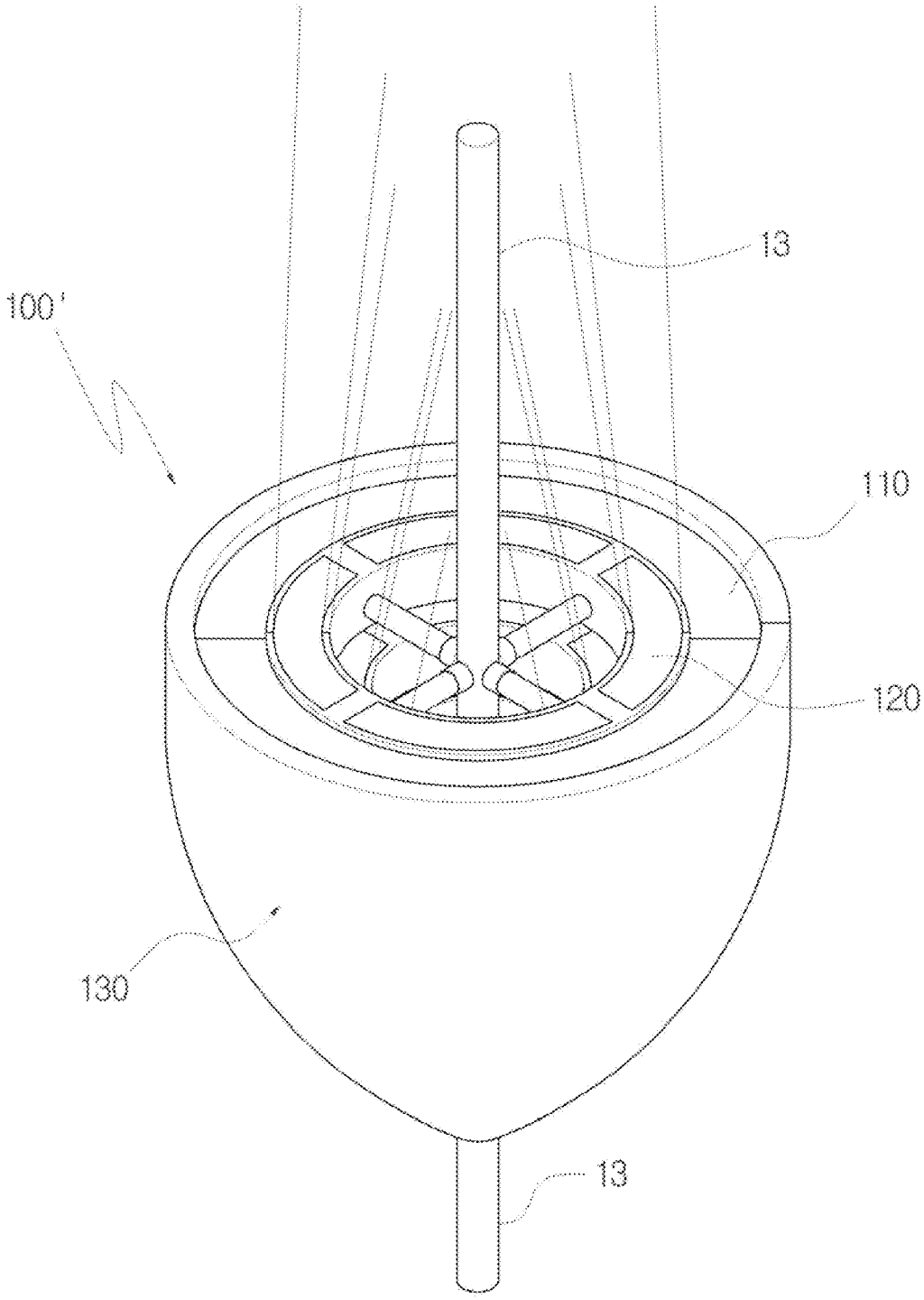
FIG. 2 is a perspective view showing an embodiment of a light according to the present invention.
Figure 3:
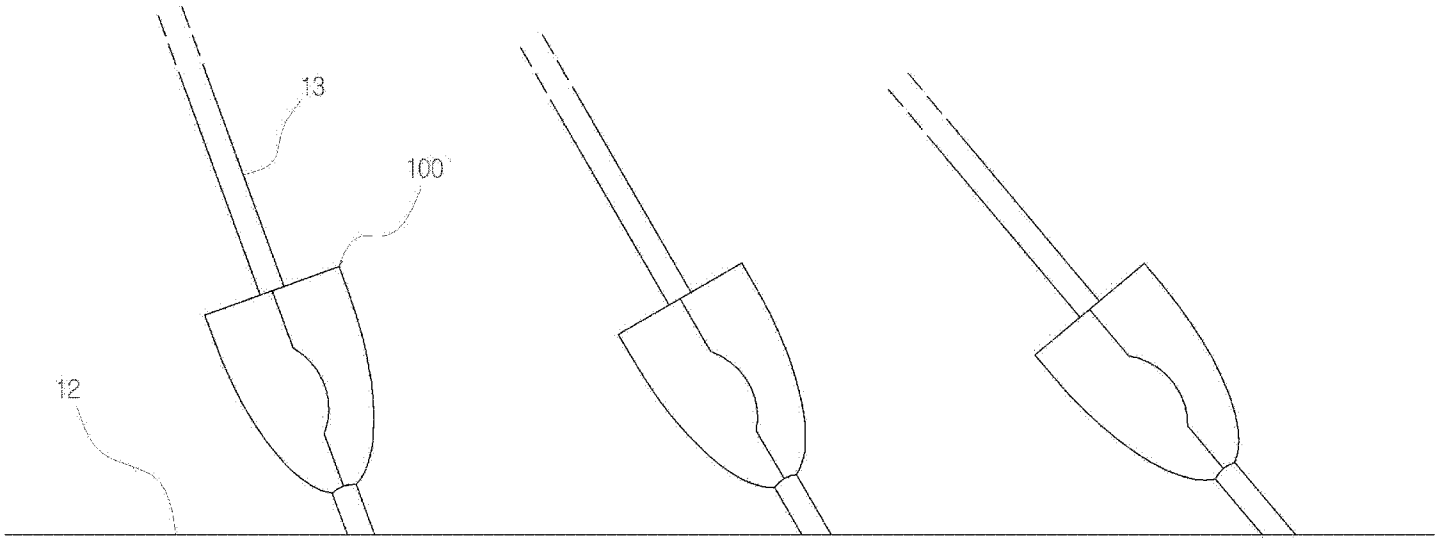
FIG. 3 is a view showing a state of installing the light according to the present invention to a bridge.

Referring to FIGS. 2 and 3, FIG. 2 is a perspective view showing an embodiment of a light according to the present invention, and FIG. 3 is a view showing a state of installation of the light according to the present invention to a bridge.

A light 100' according to the present invention includes a frame 110, on which a plurality of lamps 120 are installed, and a housing 130 for surrounding and protecting the frame 110 and also fixing the frame 110 at a predetermined location. In this case, the frame 110 and the housing 130 are shaped such that a cable 13 can extend through the frame 110 and the housing 130 as shown.

Figure 1:
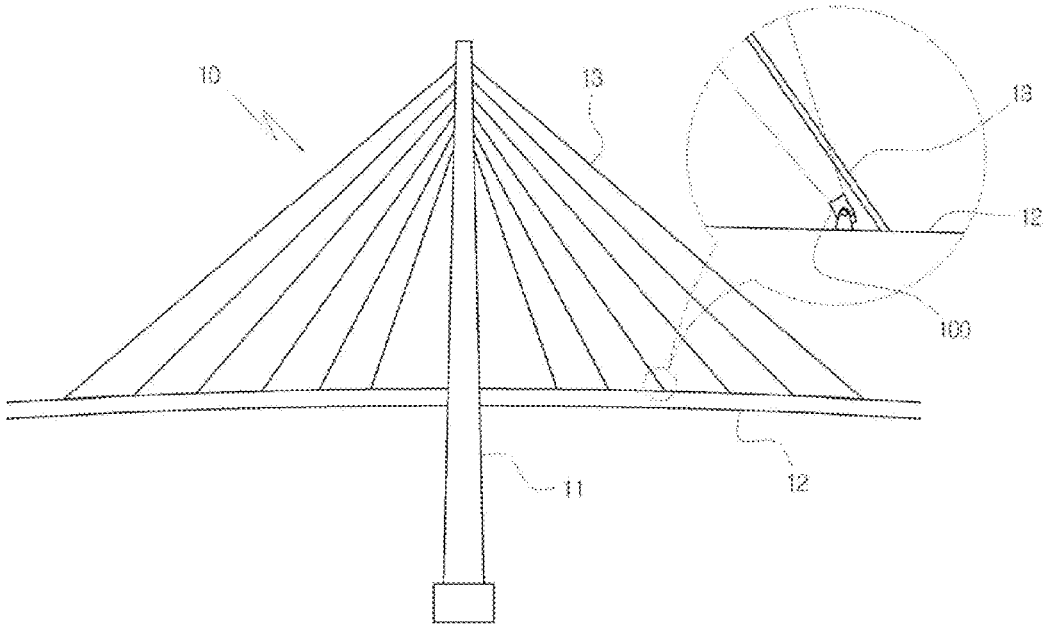
FIG. 1 is a view schematically showing a state of installation of lights which illuminate a cable-stayed bridge.

Meanwhile, although the light 100' according to the present invention is preferably applied to a particular subject such as a cable-stayed bridge 10, it is natural to apply the light to other subjects which are constituted of a cable 13, a similar rod and the like. Accordingly, although the cable-stayed bridge 10 (see FIG. 1) is described as the only subject, to which the light 100' is applied, in the following description, the subject is not limited to the cable-stayed bridge 10, but may be changed within the scope of the invention as disclosed in the accompanying claims.

As described above, the cable-stayed bridge 10 is a structure in which a deck slab is fixed and connected by a plurality of cables 13 which are connected to the deck slab 12 at predetermined intervals. In this case, the light 100' according to the present invention is fixed on each of the cables 13 to allow the cable 13 to be extended therethrough, such that the light 100' can effectively illuminate the entire peripheral surface of the cable. In addition, the light 100' is integrally connected and fixed on the cable 13, and thus the light 100' can move along with a cable 13 swaying in strong wind. As a result, the light 100' is oriented in a moving direction depending on swaying of the cable 13, such that an illumination direction thereof can be automatically adjusted, and scattering of the light 100' caused by an external force, which is applied by the cable 13, can be minimized because of movement along with swaying of the cable 13.

For reference, as shown in FIG. 3, the cables 13 of the cable-stayed bridge 10 are at a steeper angle as the cables 13 are closed to a tower 12 (see FIG. 1), and, correspondingly the housing 130 of the light 100' is also at a different angle depending on an installation location thereof.

Figure 4:
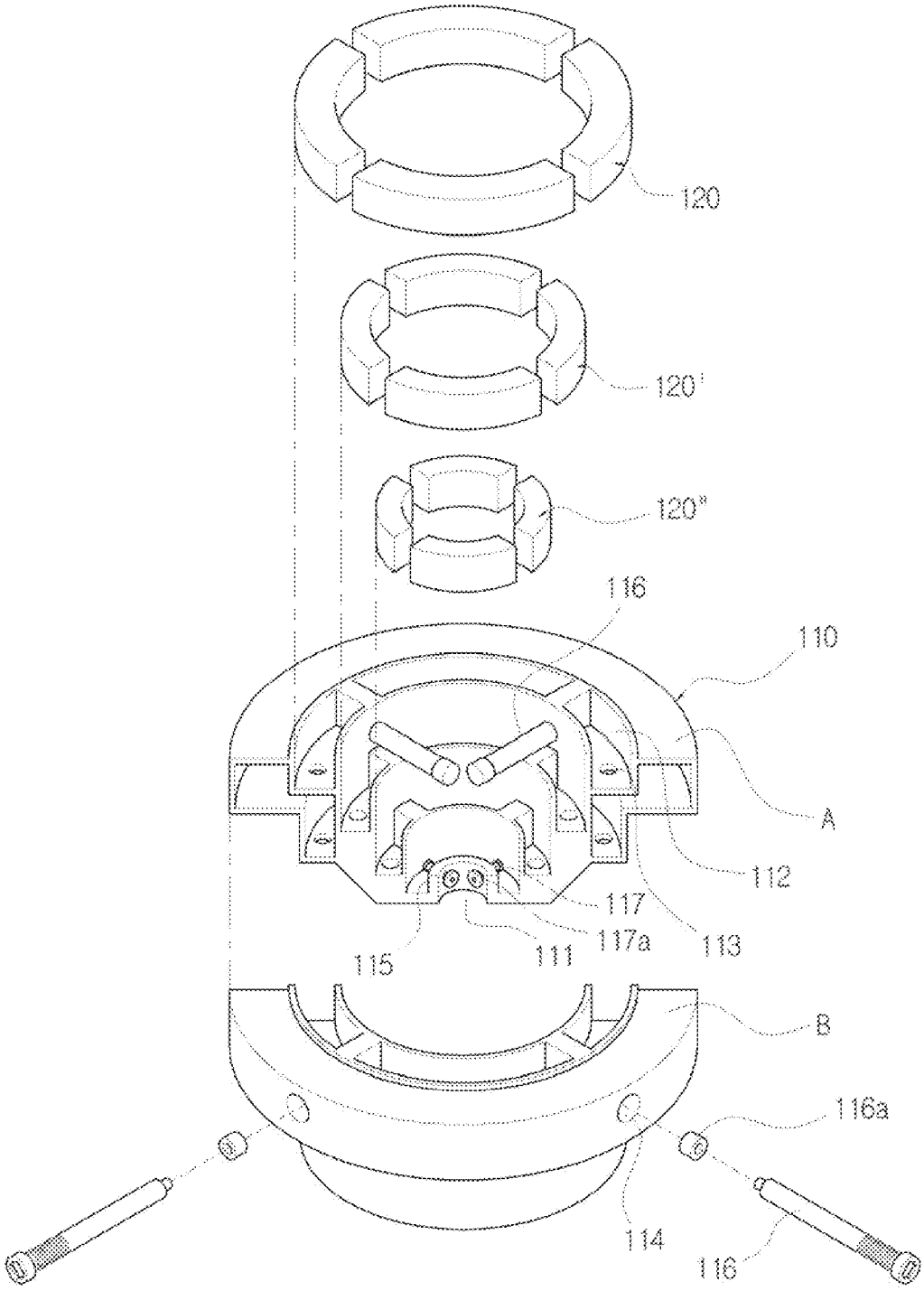
FIG. 4 is an exploded perspective view showing an embodiment of a frame of the light according to the present invention.
Figure 5:
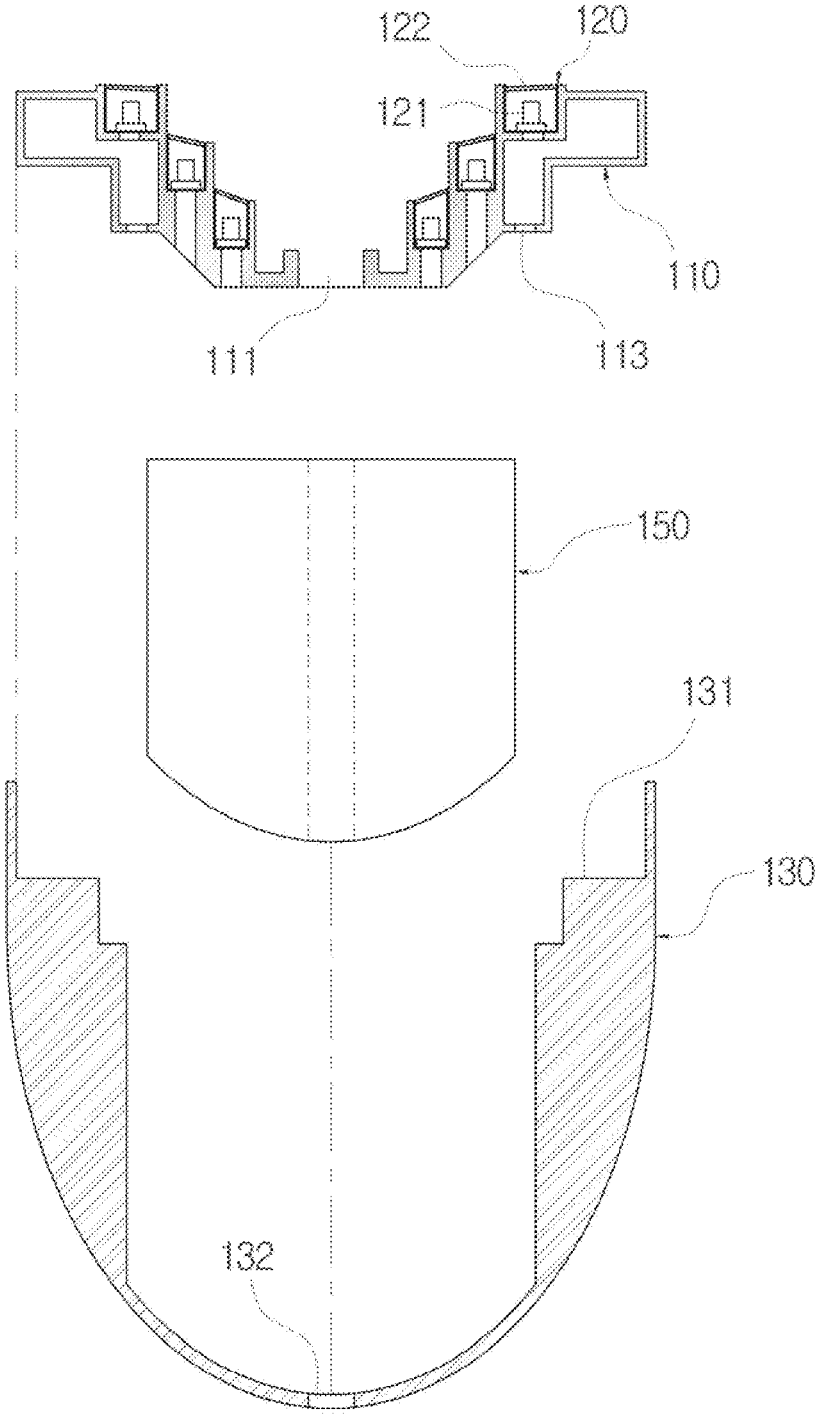
FIG. 5 is a sectional view showing the embodiment of the frame of the light according to the present invention.

Referring to FIGS. 4 and 5, FIG. 4 is an exploded perspective view showing an embodiment of the frame of the light according to the present invention, and FIG. 5 is a sectional view showing the embodiment of the frame of the light according to the present invention.

The frame 110 of the light 100' according to the present invention includes a through-hole 111 formed therein to allow the cable 13 to be extended therethrough, and a plurality of lamp mounting grooves 112 disposed in concentric circles around the through-hole 111 for mounting first, second, and third lamps 120, 120' and 120". Of course, although the lamp mounting grooves 112 can be disposed in any polygon shape other than the circles, such concentric circles are preferred to maintain a constant interval between the cable 13 and the first, second and third lamps 120, 120' and 120".

Also, the plurality of lamp mounting grooves 112 disposed in concentric circles has a stepped shape in which the lamp mounting grooves 112 are recessed deeper as the lamp mounting grooves 112 are closed to the cable 13. As a result, the first, second and third lamps 120, 120' and 120" mounted in the lamp mounting grooves 112 can concentrate their illumination on the cable 13 without scattering of the light beam, and light source points can be dispersed not to be visibly focused to the light 100', not to the cable 13. Specifically, when the first, second and third lamps 120, 120' 120" emitting light are placed on an identical plane, the plane has a very high brightness because light sources of the first, second and third lamps 120, 120' and 120" are all concentrated. Namely, when such an illuminated scene is seen from a long distance, the attention associated with the scene can be only concentrated on the plane in which the first, second and third lamps 120, 120' and 120" are located, and an outline of the cable 13 adjacent to the light cannot be seen due to the excessive brightness. However, when the first, second and third ramps 120, 120' and 120" are disposed in a stepped shape in which a middle portion thereof is deeper recessed, light sources are dispersed such that the cable 13 is effectively illuminated, and in terms of structure, such a stepped shape can perform a function of a lampshade for guiding the light beam in a predetermined direction, and thus the illuminating efficiency in a longitudinal direction of the cable 13 can be maximized.

Meanwhile, the first, second and third lamps 120, 120' and 120" may each have an arch shape in which a plurality of light sources 121 are mounted as shown, and alternatively, the light sources 121 themselves may be separately mounted in the lamp mounting grooves 112.

In addition, light beam paths need to be refracted such that the light beams irradiated from the light sources 121 can be concentrated on and illuminate the cable 13. To this end, the first, second and third lamps 120, 120' and 120" according to the present invention each further include a lens 122.

The lens 122 adjusts the light beam path as described above, and as the lamps are more closed to the cable 13, the corresponding lens 122 has a higher refractive index such that the light beam of the corresponding lamp can directly illuminate the cable 13. Because bridges such as a cable-stayed bridge are roads for crossing a sea or a river, fog can frequently occur due to their location. When the cable 13 is illuminated in a stepped shape, the illumination can be dispersed over a relatively large range in the longitudinal direction of the cable 13, and thus the cable 13 can be readily discerned even when there is fog. In particular, because the lamps (in particular, the third lamp 120") which are closer to the cable 13 can directly illuminate the cable 13 itself, a point where the light 100' is fixed on the cable 13 can be seen from a long distance at a night or even under foggy conditions. Of course, such an advantage can provide a function of guiding vehicles or pedestrians crossing bridges, thereby ensuring the safe crossing of the vehicles or pedestrians.

Meanwhile, because the first, second and third lamps 120, 120' and 120" are separately mounted in each of the lamp mounting grooves 112, electric wirings for operating the first, second and third lamps 120, 120' and 120" have to be provided. Therefore, the lamp mounting grooves 112 each have a wiring hole 113 formed therein through which the electric wirings can be extended, such that the electric wirings introduced from the outside can be connected to the first, second and third lamps 120, 120' and 120".

Furthermore, the light 100' according to the present invention may additionally have first and second fastening bolts 116 and 117 to enhance the strength of their connection to the cable 13.

A plurality of first and second fastening bolts 116 and 117 are horizontally inserted into a circumferential surface of the frame 110 in a radial shape, and thus surround and fix the peripheral surface of the cable 13 vertically extending through the frame 110. Also, the first and second fastening bolts 116 and 117 are disposed in a pair on upper and lower end portions of the frame 110. Specifically, the first fastening bolts 116 located on the upper end portion of the frame 110 are first tightly fixed on the peripheral surface of the cable 13, and then the second fastening bolts 117 located on the lower end portion of the frame 110 are tightly fixed on the peripheral surface of the cable 13, thereby ensuring a strong fastening between the cable 13 and the light 100'.

To this end, fastening holes 114 are formed along the circumferential surface of the frame 110 to horizontally pass through the through-hole 111, and thus the first fastening bolts 116 having a bar shape can be inserted through the fastening holes 114. For this, female screw threads (not shown) are formed on inner surfaces of the fastening holes 114 and male screw threads are correspondingly formed on circumferential surfaces of the first fastening bolts 116, and thus the first fastening bolts 116 are securely fixed in the fastening holes 114 by coupling between the female and male screw threads.

One end of each of the first fastening bolts 116 which have been fixed in such a manner is tightly fixed to the cable 13, and thus the peripheral surface of the cable 13 is surrounded by the one ends of the first fastening bolts 116 and can be securely fastened to the frame without play. For reference, the other ends of the first fastening bolts 116 may have a tightening groove formed thereon to which a tool such as a screw driver can be inserted, and then an operator can apply a rotational force to the first fastening bolts 116 via the tightening groove, such that the first fastening bolts 116 can be horizontally moved through the fastening holes 114 of the frame 110.

Meanwhile, the second fastening bolts 117 are extended through and fixed in a wall portion 115 which protrudes in the longitudinal direction of the cable 13 to surround the through-hole 111. The second fastening bolts 117 are also tightly fixed on the peripheral surface of the cable 13 by a screw thread engagement similar to the coupling between the first fastening bolts 116 and the fastening holes 114.

One ends of first and second fastening bolts 116 and 117 directly contacted with the cable 13 each additionally have first and second abutting pieces 116*a* and 117*a* to be intimately surrounded and sufficiently abutted against the cable 13. The first and second abutting pieces 116*a* and 117*a* are preferably formed of a material having a high surface friction coefficient and elasticity, and can be typically made using a synthetic resin, such as a rubber. In addition, the first and second abutting pieces 116*a* and 117*a* are rotatably secured on the one ends of the first and second fastening bolts 116 and 117, such that, upon rotation of the first and second fastening bolts 116 and 117, the first and second abutting pieces 116*a* and 117*a* each can be abutted against the cable 13 and kept in a stopped state, whereas the first and second fastening bolts 116 and 117 can be smoothly rotated and press the cable 13.

The light 100' according to the present invention can be installed and applied to the cable 13 of an existing cable-stayed bridge 10, and thus the frame 110 surrounding the cable 13 has to be constituted of a structure which allows for assembly. Therefore, the frame 110 has a divided structure in semi-circular shapes to be assembled later, and after being assembled, is coupled together via a known or used fastening means. To this end, the light 100' according to the invention further includes the housing 130 surrounding and fixing the frame 110 which has been assembled.

The housing 130 has a supporting shoulder 131 protruding from an inner surface thereof to securely fix and support the frame 10 without play, and a hollow portion formed therein for receiving a switch 150 which controls the on/off state of the first, second and third lamps 120, 120', 120". For reference, the switch 150 is connected to the first, second and third lamps 120, 120', 120" via the electric wirings, and thus controls on/off state of the first, second and third lamp 120, 120', 120" depending on whether it is day, night or changing between them, etc.

Figure 6:
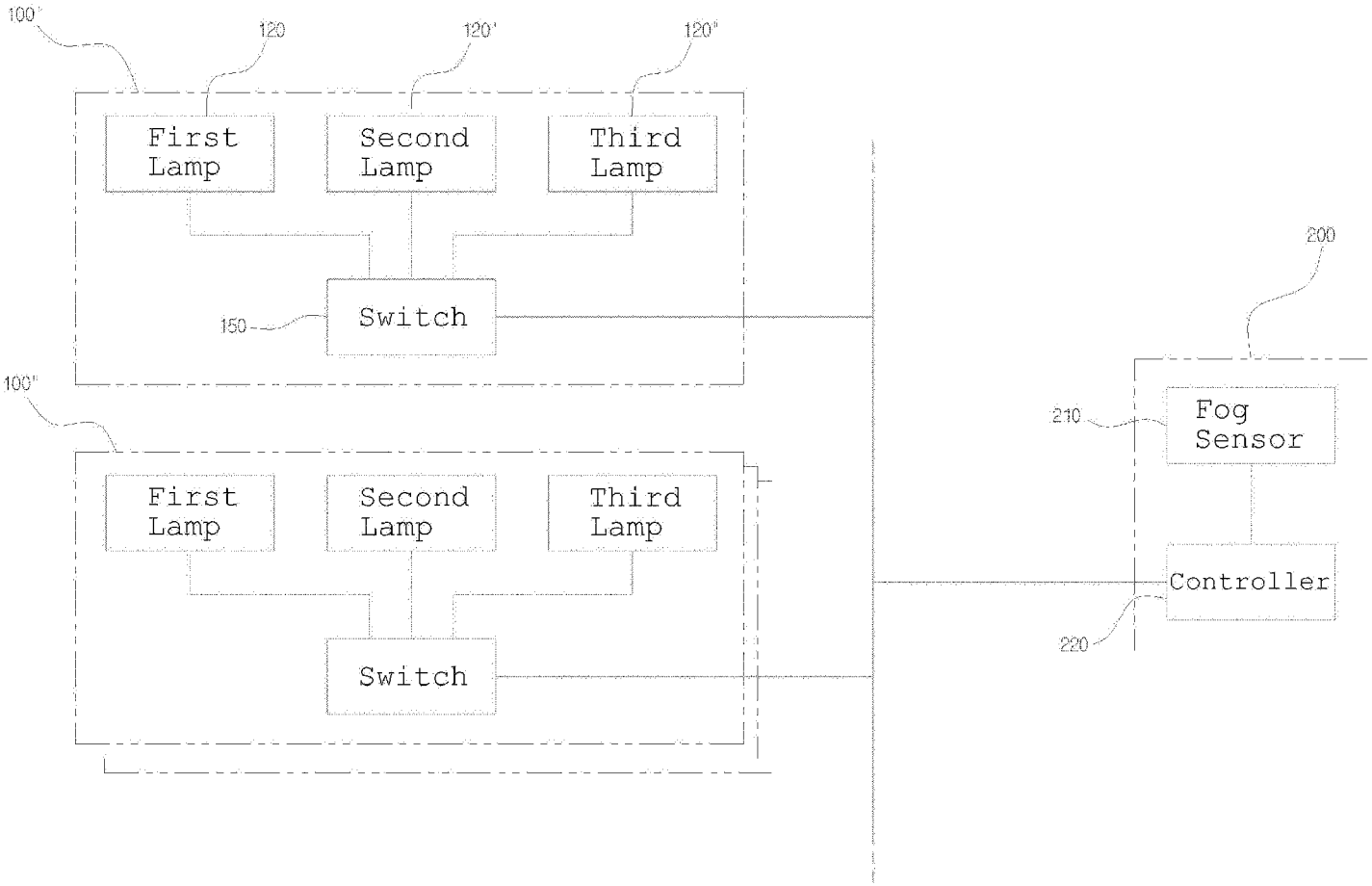
FIG. 6 is a block diagram showing a configuration for remotely controlling the light of the present invention.

Now, referring to FIG. 6, FIG. 6 is a block diagram showing a configuration for remotely controlling the light of the present invention.

One or more lights 100' and 100" are installed on each of the cables 13 of the cable-stayed bridge 10, so that a lot of lights 100' and 100" are installed on a single cable-stayed bridge 10. Accordingly, a control box 200 is additionally provided to control the numerous lights 100' and 100", and the switch 150 for each of the lights 100' and 100" controls the on/off status of the first, second and third lamps 120, 120', 120" under control of the control box 200.

Meanwhile, for a clear night, the first lamp 120 is only turned on, whereas the first, second and third lamps 120, 120', 120" are all turned on on foggy nights. Therefore, the control box 200 includes a controller 220 for controlling the switch 150 for each of the lights 100' and 100", and a fog sensor 210 for sensing the presence of fog. Accordingly, the fog sensor 210 continuously checks weather conditions, and when fog has been detected, transfers an associated signal to the controller 220. Then, the controller 220 controls the switch 150 to turn on the first, second and third lamps 120, 120', 120". As a result, the cables 13 of the cable-stayed bridge 10 can be readily identified irrespective of weather conditions.

For reference, the fog sensor 210 and the controller 220, together with the switch 150 for turning on/off a plurality of lamps, are employing a known or used technology, and thus a detailed description of the mechanical/electrical structures thereof will be omitted.

Figure 7:
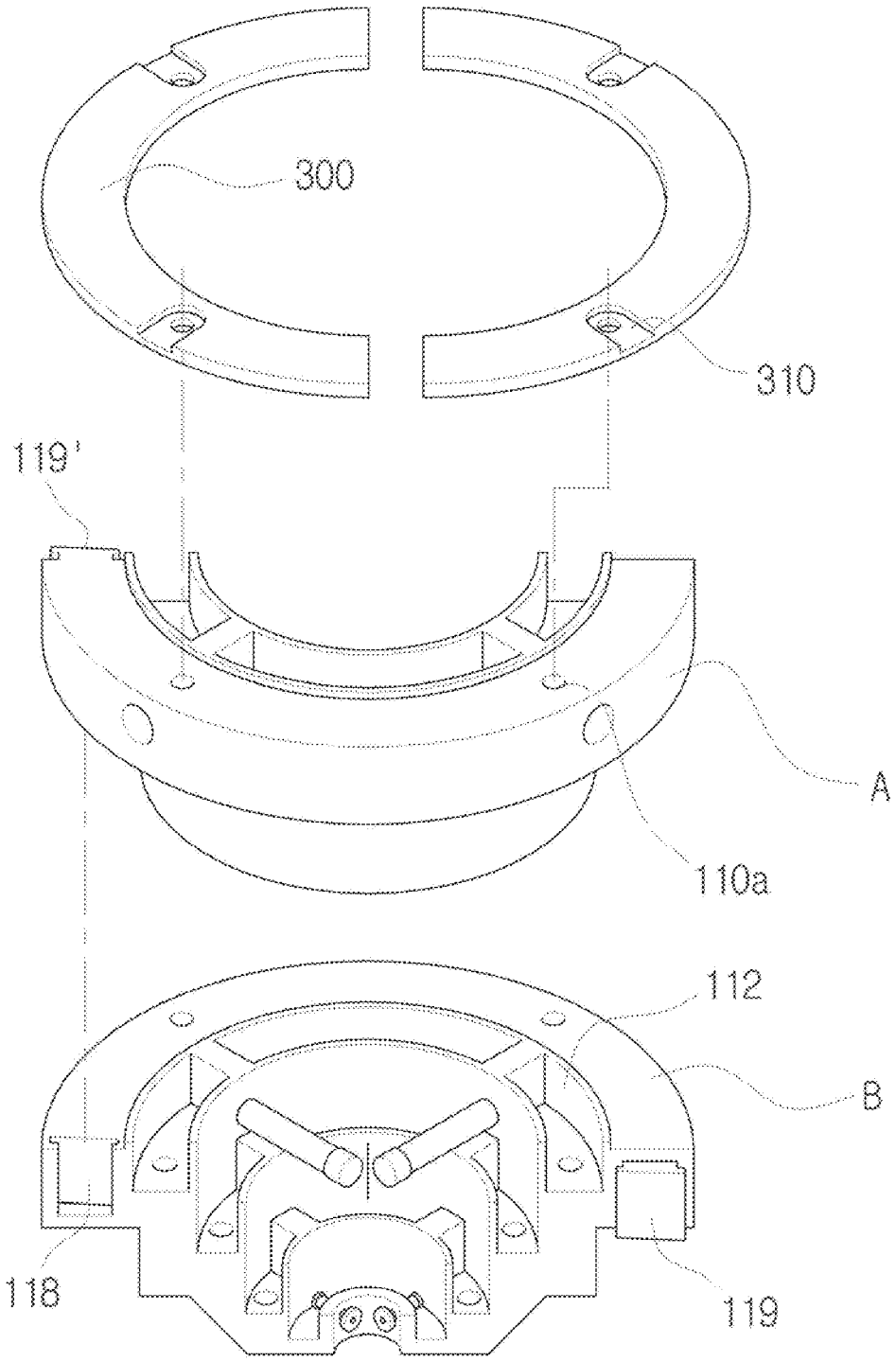
FIG. 7 is an exploded perspective view showing another embodiment of a frame according to the present invention.

Referring to FIG. 7, FIG. 7 is an exploded perspective view showing another embodiment of a frame according to the present invention.

As described above, the light 100' according to the present invention is applied to an existing installed cable 13 and the like. Therefore, the frame 110 constituting a basic framework of the light 100' has a structure which allows for assembly and disassembly.

First and second bodies A and B which each have a semi-circular shape obtained by dividing the frame 110 are assembled together, using a variety of fastening means. In the embodiment according to the present invention, a sliding technique using a fastening groove 118 and a fastening protrusion 119 or 119' is employed. The fastening groove 118 and the fastening protrusion 119 or 119' are formed in each of surfaces of the first and second bodies A and B which contact each other, such that the fastening protrusion 119' can be inserted and engaged in the fastening groove 118, thereby fastening them to each other. As a result, the first and second bodies A and B each having the semi-circular shape obtained by dividing in two parts can be assembled into a complete frame 110 having a circular shape.

For reference, the fastening groove 118 and the fastening protrusion 119 or 119' are formed in each of surfaces of the semi-circle shaped first and second bodies A and B which contact each other, and thus the fastening groove 118 and the fastening protrusion 119 or 119' are engaged with each other by sliding up and down one relative to each other.

Next, after the circular frame 110 has been completed, finishing bands 300 each having a semi-circular shape are placed on an upper surface of the frame 110, and then the frame 110 and the finishing bands 300 are fixed to each other using a fastening means (not shown), such as bolts or pins, which are inserted into fastening holes 110*a* of the frame 110 and catching holes 310 of the finishing bands 300.

In this case, the finishing bands 300 are placed to cover a border portion in which the first and second bodies A and B contact each other, and thus can also perform a function of creating a linkage which connects the first and second bodies A and B to each other.

What is claimed is:

1. A light combined with a cable, comprising:

a frame (110) comprising: a through-hole (111) configured to allow the cable (13) to be extended therethrough; a plurality of lamp mounting grooves (112) disposed along a circumference of the through-hole (111), the lamp mounting grooves (112) being formed in a stepped shape such that lamp mounting grooves closer to the through-hole (111) are recessed deeper than those farther away from the through-hole; fastening holes (114) formed along the circumferential surface of the frame (110) to horizontally pass through the through-hole (111), the fastening holes (114) each having an inner surface provided with a female screw thread; and bar-shaped first fastening bolts (116) each extending through one of the fastening holes (114), the first fastening bolts (116) each having a circumferential surface provided with a male screw thread so as to engage with the female screw thread;

a plurality of lamps (120) fixed in the respective lamp mounting grooves (112) and each having light sources (121) for emitting a light beam;

a housing (130) for accommodating and surrounding the frame (110); and a switch (150) installed within the housing (130) for controlling an on/off state of the lamps (120).

2. The light according to claim 1, wherein one end of each of the first fastening bolts (116) which is abutted against the cable (13) includes a first abutting piece (116*a*) formed of an elastic material and rotatably secured thereon.

3. The light according to claim 1, further comprising:

a wall portion (115) protruding along the circumference of the through-hole (111); and a plurality of second fastening bolts (117) horizontally extending through the wall portion (115) and being horizontally moved by a screw thread engagement.

4. The light according to claim 3, wherein one end of each of the second fastening bolts (117) which is abutted against the cable (13) includes a second abutting piece (117*a*) formed of an elastic material and rotatably secured thereon.

5. The light according to claim 1, wherein each of the lamps (120) further comprise a lens (122) for adjusting an irradiation direction of the light beam emitted from the light sources (121), wherein, as the lamps (120) become closer to the cable (13), the corresponding lens (122) refracts the light beam to be more directly irradiated on the cable (13).

6. The light according to claim 1, wherein the frame (110) includes first and second bodies (A and B), which can be assembled and disassembled around the through-hole (111), to be releasably attached on the cable (13).

7. The light according to claim 6, wherein each of surfaces of the first and second bodies (A and B) which contact each other is provided with a fastening groove (118) and a fastening protrusion (119 or 119') configured to engage each other by sliding one relative to the other.

8. The light according to claim 6, further comprising:

a plurality of finishing bands (300) placed and fixed on an upper surface of the completed frame (110) obtained by assembling the first and second bodies (A and B) together, wherein the finishing bands (300) are disposed to cover a border portion in which the first and second bodies (A and B) contact each other.

9. The light according to claim 7, further comprising:

a plurality of finishing bands (300) placed and fixed on an upper surface of the completed frame (110) obtained by assembling the first and second bodies (A and B) together, wherein the finishing bands (300) are disposed to cover a border portion in which the first and second bodies (A and B) contact each other.

* * * * *